US006408762B1

(12) United States Patent
Schmacker et al.

(10) Patent No.: US 6,408,762 B1
(45) Date of Patent: Jun. 25, 2002

(54) CLAMP ASSEMBLY FOR SHROUDED AERIAL BOMB

(75) Inventors: Bruce E. Schmacker; Ronald L. Wooten, both of Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/555,119

(22) Filed: May 25, 2000

Related U.S. Application Data

(63) Continuation of application No. PCT/US97/23112, filed on Dec. 11, 1997.

(51) Int. Cl.[7] ..... F42B 10/00

(52) U.S. Cl. ..... 102/382; 102/489; 102/518; 89/1.54; 89/1.58

(58) Field of Search ..... 102/382, 385, 102/393, 473, 489, 517, 518; 89/1.53, 1.54, 1.58

(56) References Cited

U.S. PATENT DOCUMENTS

| | | | | |
|---|---|---|---|---|
| 3,224,334 A | | 12/1965 | Curtis et al. | |
| 4,597,333 A | | 7/1986 | Böcker et al. | 102/518 |
| 4,638,737 A | | 1/1987 | McIngvale | 102/489 |
| 4,656,943 A | | 4/1987 | Edminster | 102/208 |
| 4,911,080 A | | 3/1990 | Leeker et al. | 102/529 |
| 4,920,887 A | | 5/1990 | Frehaut et al. | 102/489 |
| 4,932,326 A | | 6/1990 | Ladriere | 102/364 |
| H959 H | | 9/1991 | Heckman et al. | 102/489 |
| 5,056,408 A | | 10/1991 | Joner et al. | 89/1.51 |
| 5,103,734 A | | 4/1992 | Arnaud et al. | 102/489 |
| 5,656,792 A | | 8/1997 | Rentzsch et al. | 102/489 |
| 5,939,662 A | * | 8/1999 | Bootes et al. | 102/473 |
| 6,012,393 A | * | 1/2000 | Tal | 102/382 |

FOREIGN PATENT DOCUMENTS

WO WO 99/30106 6/1999

OTHER PUBLICATIONS

U.S. Patent Application No. 09/577,571 filed May 25, 2000, Bruce E. Schmacker et al.

* cited by examiner

*Primary Examiner*—Harold J. Tudor
(74) *Attorney, Agent, or Firm*—Burns, Doane, Swecker & Mathis, LLP

(57) ABSTRACT

A target penetrating aerial bomb including a penetrating body shaped for improved target penetration, having a narrower impact profile at approximately the same weight as an existing bomb. An aerodynamic shroud encases the penetrating body and emulates the aerodynamic shape of the existing bomb, and the weight, center of gravity, and moments of inertia of the bomb closely approximate those properties of the existing bomb. The bomb constructed according to the present invention may be qualified by similarity to the existing bomb, thus avoiding lengthy and costly qualification procedures.

18 Claims, 3 Drawing Sheets

CLAMP ASSEMBLY FOR SHROUDED AERIAL BOMB

This application is a continuation of International Application PCT/US97/23 112 filed Dec. 11, 1997, and Applicants claim priority thereto under 35 U.S.C. §120.

STATEMENT REGARDING FEDERALLY SPONSORED RESEARCH OR DEVELOPMENT

At least some aspects of this invention were made with Government support under contract no. F08630-92-C-0004. the government may have certain rights in this invention.

The present invention relates to aerial bombs, that is, bombs dropped from aircraft, and more particularly, to aerial bombs for penetrating hard targets.

BACKGROUND

A bomb typically includes a hard casing having an interior hollow space for containing an explosive material. The physical characteristics of the bomb, including the weight, center of gravity, moments or inertia, and the aerodynamic shape, all affect the free-fall response of the bomb, whether or not a guidance package is included with the bomb.

Bombs delivered from aircraft, including free-fall guided or unguided bombs, glide bombs, and boosted bombs, must pass rigorous field testing which includes the safe release from a deploying aircraft and accuracy of delivery to the target. These tests must be conducted for each type of aircraft that will carry the bomb. The development of new weapons, therefore, is subject to significant delay and expense before the weapon is qualified for use.

SUMMARY OF THE INVENTION

The ability of a bomb, or other projectile, to penetrate a target is proportional to the mass and the velocity of impact of the projectile and inversely proportional to the cross-sectional area of the bomb. That is, the greater the kinetic energy and the smaller the cross-sectional area, the greater the penetration that can be expected. To adapt an existing bomb for greater penetration by reducing the external diameter of the bomb can also result, however, in changes in the mass properties such as weight, center of gravity, moment of inertia, and in the aerodynamic properties, all of which can affect the flight characteristics of the bomb. These changes also require that the adapted bomb be qualified for use.

The present invention provides an aerial bomb that overcomes the difficulty in qualification by emulating the pertinent aerodynamic characteristics and mass properties of a qualified bomb, while providing a function not provided by that bomb.

More particularly, the present invention provides a bomb having an improved penetrating warhead, that is, a warhead that more deeply penetrates a protected target, however, the bomb is substantially identical in aerodynamic and mass properties to a qualified bomb. As a result, the bomb of the present invention may be readily qualified by similarity of function to the existing bomb for use on an aircraft In addition, if desired, the bomb of the invention can use existing guidance packages available for the qualified bomb.

To avoid lengthy and expensive delays required to qualify a new bomb, the invention provides a bomb that emulates the free-fall properties of an existing bomb pertinent to qualification, while at the same time, providing a warhead with the desired improved penetrating capability.

According to the invention, the warhead is a penetrating body shaped for improved target penetration through a smaller cross-sectional area compared to an existing qualified bomb. An aerodynamic shroud mounted around the warhead emulates the shape of the qualified bomb, and the weight, center of gravity and moments of inertia of the bomb (the penetrating body and shroud) closely approximate those properties of the existing bomb.

BRIEF DESCRIPTION OF THE DRAWINGS

The invention will be better understood by reference to the following detailed description in conjunction with the appended drawings, in which.

DETAILED DESCRIPTION

Figure 1:
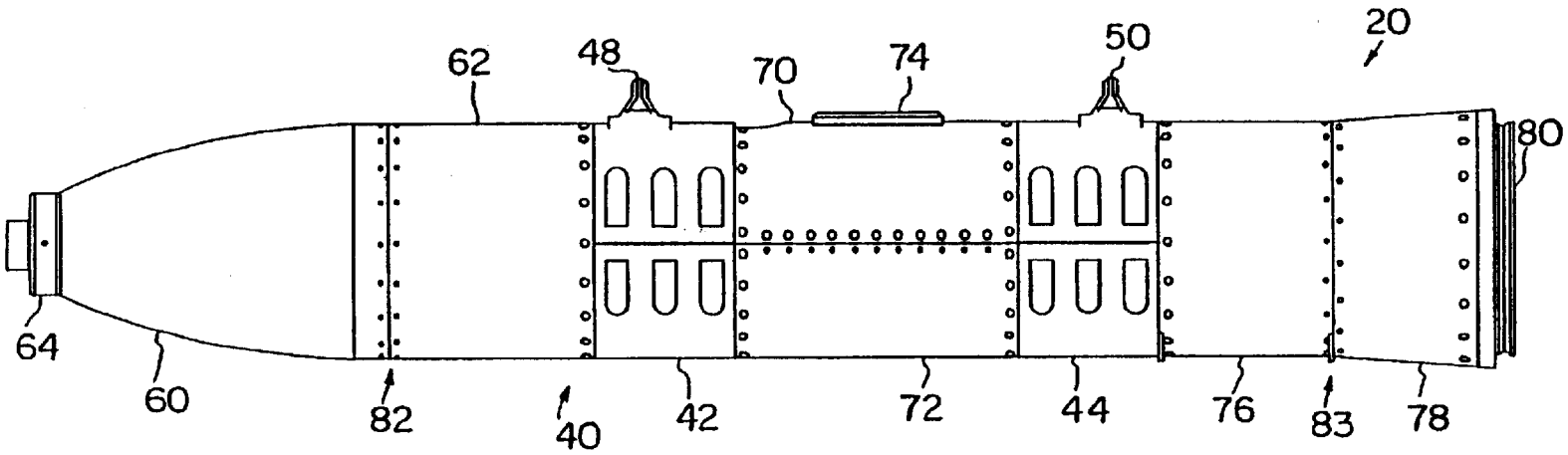
FIG. 1 is a side view of a bomb in accordance with the invention.
Figure 2:
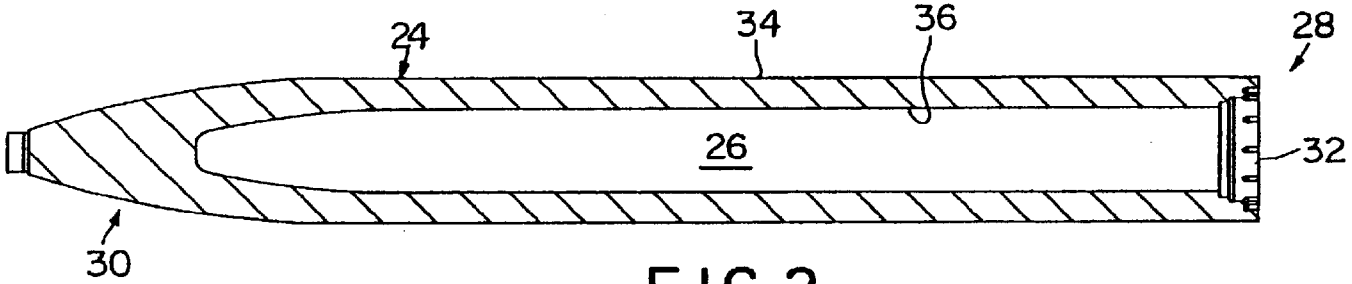
FIG. 2 is a side, section view of a penetrating body of the bomb of FIG. 1.

FIG. 1 is a side view of a shrouded bomb 20 in accordance with the invention. The bomb 20 includes a penetrating body 24 or warhead (shown in FIG. 2) and a shroud 40 shaped to emulate the aerodynamic shape of an existing qualified bomb. In the exemplary embodiment, the bomb 20 is shaped to emulate the BLU-109/B bomb, that is, the outer shape of the shroud 40 is substantially identical to the outer shape of the hard case of the BLU-109/B. In addition, the weight, center of gravity, and moments of inertia of the bomb 20 are substantially identical to those physical characteristics of the BLU-109/B.

The bomb 20 will therefore have the same free-fall and aerodynamic properties as the emulated bomb, and as a result can be carried on any aircraft for which the emulated bomb is qualified. Further, the bomb 20 can be used with any guidance package appropriate for the emulated bomb. The improved bomb 20, however, avoids the lengthy and costly flight qualification tests because it is qualified by similarity to the qualified bomb. The invention thus provides an aerial bomb that improves on the function of an existing bomb, but qualifies for use by emulating the handling and aerial delivery characteristics of the existing bomb.

The invention is not limited to emulating a particular qualified bomb, such as the BLU-109/B, which is used as an example here, but, as will be appreciated by those skilled in the art from the following description, the invention may be directed to improvements in other existing bombs.

The penetrating body 24 in the illustrative embodiment is designed for improved target penetrating capability. The penetrating body 24 includes a case formed of a hard, dense material such as steel, tungsten, or depleted uranium. The penetrating body 24 is narrower than the case of the emulated bomb to provide a smaller cross sectional area The penetrating body 24 has an interior hollow space 26 that may contain an explosive. The space 26 opens at the tail end of the body 28 and extends toward the nose 30, leaving a solid, nose section. A bulkhead 32 is attached to the penetrating body 24 to close the opening at the tail and to support mounting of a fuze that activates the warhead, as further described below.

In the example provided of the BLU-109/B as the qualified bomb, the penetrating body 24 is narrower than a BLU-109/B, but has thicker walls to maintain most of the weight of the BLU-109/B. According to the exemplary embodiment, the penetrating body 24 has a weight (loaded with an explosive charge) that is between 80% and 90% of the weight of the BLU-109/B. The reduced diameter with approximately the same weight increases the penetration ability of the penetrating body as compared to the BLU-109/B by focusing kinetic energy on a smaller impact are. It is understood that the invention is not limited to a particular diameter or weight ratio as compared to an emulated bomb. The diameter and weight of the warhead are to be selected, for example, for the penetrating and explosive functions desired, within the constraint of the total weight of the warhead and shroud being approximately equal to that of the emulated weapon The penetrating body 24 is shaped at the nose end 30 with an ogive having a variable radius of curvature. The nose end 30 outer shape leads to a cylindrical center portion 34. The outer diameter of the penetrating body 24, measured at the cylindrical center portion 34 is 10.7 inches, as compared to an outer diameter of the BLU-109/B of 14.6 inches at a center portion. The thickness of the wall 36 of the penetrating body surrounding the bore 26 is 2.26 inches.

Figure 3:
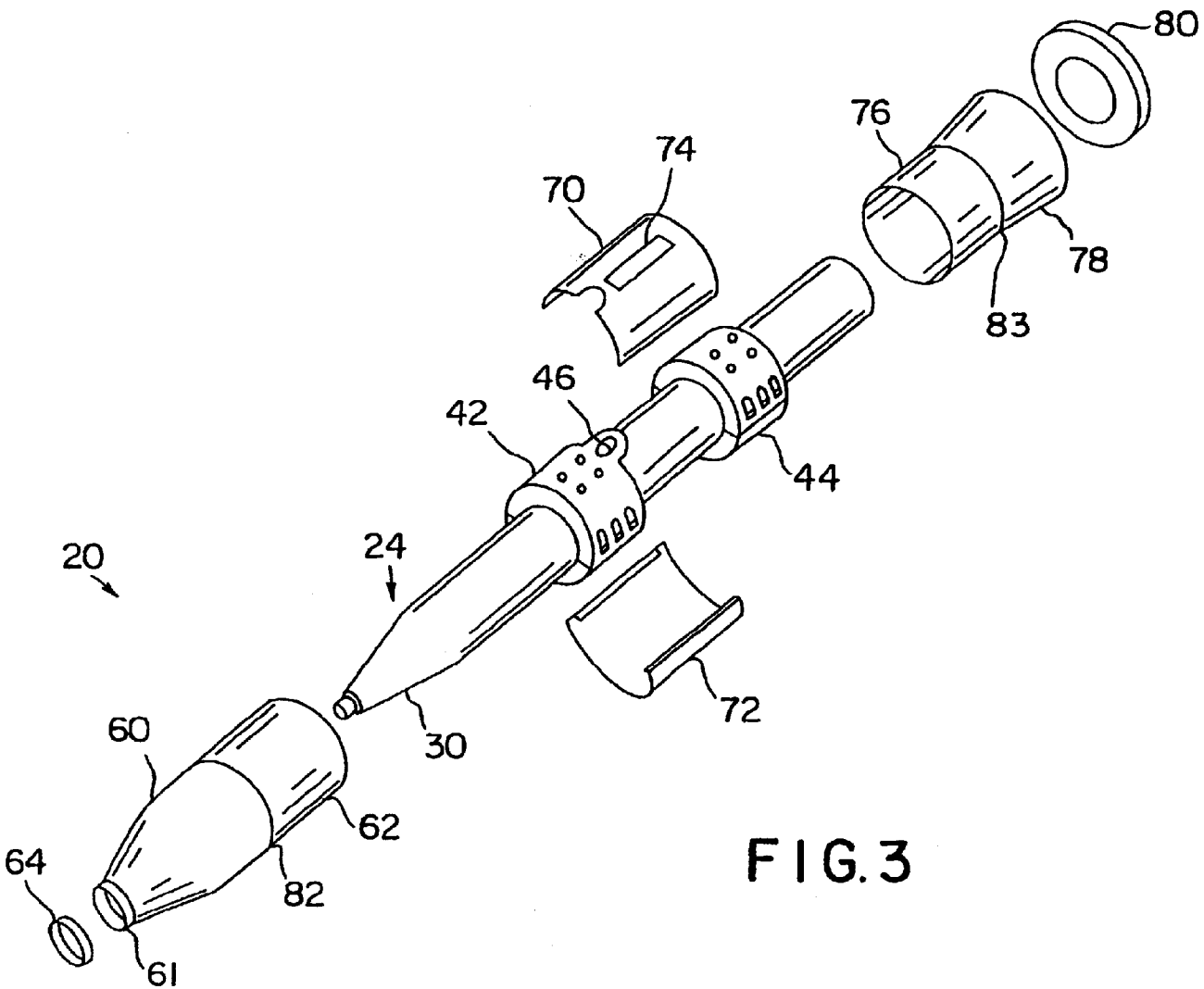
FIG. 3 is a perspective, exploded view of the bomb of FIG. 1 illustrating the various components of the shroud assembly and penetrator.

FIG. 3 is an exploded view of the shroud 40 and penetrating body 24. The shroud 40 includes a forward clamp 42 and an aft clamp 44 that are fastened to the center portion 34 of the penetrating body 24 in spaced relationship. The clamps 42, 44 each are of two-part construction, each having a pair of semicylindrical members that are bolted together about the penetrating body 24. The clamps 42, 44 are sized on the inner diameter to closely fit the penetrating body 24 to provide supporting locations for ground handlng and storage pallets. Shear pins (not illustrated) are mounted in holes in the penetrating body 24 and extend outward therefrom to engage mating holes in the clamps 42, 44. The shear pins prevent the clamps 42, 44 from moving longitudinally and rotating relative to the penetrating body 24 during ground handling of the bomb and while carried on an aircraft Alternatively, other mechanical engagement means could be used to prevent movement of the clamps 42, 44 on the penetrating body 24. For example, longitudinal grooves formed in the penetrating body 24 could engage ribs extending from the clamps 42, 44, or the outer surface of the penetrating body 24 and the inner surfaces of the clamps 42, 44 could be formed as roughened surfaces to provide increased friction between the surfaces.

The shear pins and the clamps are designed to have a material strength so that they break under the force of impact of the bomb on a target to help the penetrating body 24 shed the shroud 40 for better penetration into the target.

The upper part of each clamp 42, 44 includes mounting holes for lugs 48, 50 to mount the bomb on an aircraft hanger system. The spacing of the lugs 48, 50 and their position relative to the center of gravity of the bomb 20 is identical to that for the selected weapon, in the illustrated embodiment, the BLU-109/B.

In adapting other qualified bombs in accordance with the invention, a single clamp may be used, depending for example, on space and load carrying requirements.

The shroud 40 also includes skin members that form the outer surface and are shaped to have the aerodynamic characteristics of the emulated bomb. The skin members include a nose cone 60 mounted at the nose 30 of the penetrating body 24, and a forward tube 62 mounted between the nose cone 60 and the forward clamp 42. The nose cone 60 and forward tube 62 are fastened together, and the forward tube 62 is fastened to the forward clamp 42. A nose ring 64 helps secure the nose cone 60 in place and provides a mounting structure for a nose guidance unit, shown in FIGS. 4 and 5.

The forward end 61 of the nose cone 60 is cylindrically shaped and extends longitudinally forward from the penetrating body 24. The forward-extending cylinder end 61 is designed upon impact of the warhead on a target to break away from the penetrating body 24, to assist the penetrating body 24 in shedding the forward portion of the shroud.

Between the forward clamp 42 and the aft clamp 44, an upper shell 70 and a lower shell 72 are fastened. The lower shell 72 is made sufficiently thick, typically about 0.5 inches, to help support the weight of the bomb during ground handling by conventional lift equipment, and for resting the bomb on storage pallets. The upper shell 70 includes a switch plate 74 which cooperates with a release-indicating switch on the aircraft, which is used to signal the release of the bomb from an aircraft.

Figure 7:
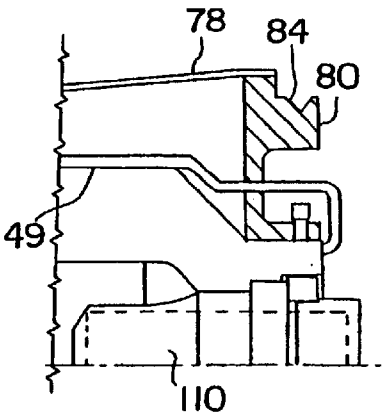
FIG. 7 is a sectional view of a tail of the shroud showing a mounting structure for a tail fin unit

Rearward of the aft clamp 44, the skin is completed by an aft tube 76 and a tail tube 78. In the illustrated embodiment, the tail tube 78 flares outward to emulate the tail shape of the BLU-109/B. A tail ring 80 is fastened on the tail end of the bomb and the shroud, and provides a mounting structure for an aerodynamic tail unit; exemplary tail units are shown in FIGS. 4 and 7.

The clamps 42, 44 provide support for ground handling and storage of the bomb on racks, pallets and lifts. Additional support is provided by support rings which are installed between the penetrating body 24 and the skin elements at the support locations 82, 83 shown by the arrows. The support rings may, for example, be "T" or "H" profiled rings, and are positioned to bridge the space between the skin and the penetrating body 24 to help support the weight of the body.

The unit 20 shown in FIG. 1 is designed to have the same length, weight, center of gravity, and aerodynamic shape of the selected, qualified weapon. As will be appreciated by those skilled in the art, the weight and center of gravity can be adjusted by ballasting the penetrating body 24 or the shroud 40, by the addition or removal of material at selected locations. For example, the length of the bore 26, or the thickness of the penetrating body walls 36 can be readily changed to adjust the weight and center of gravity. The shroud components, in particular, the clamps 42, 44, may also be adapted in weight and/or size to adjust the center of gravity and total weight.

Figure 4:
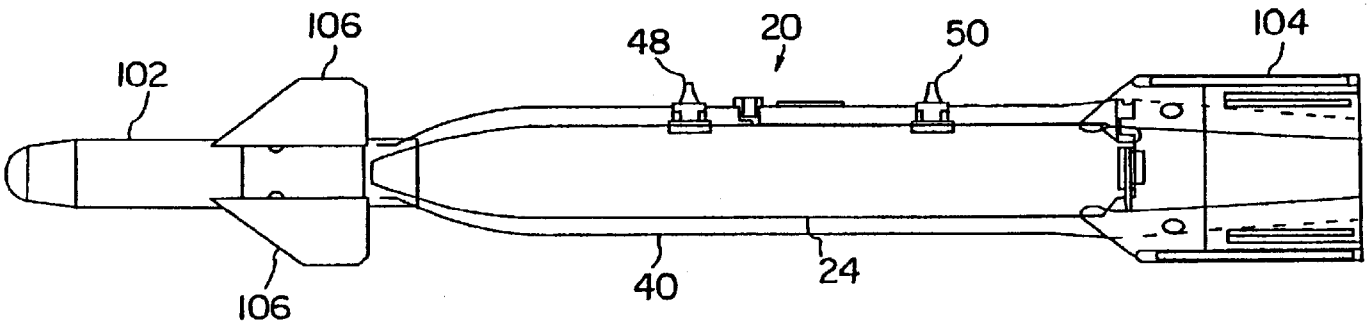
FIG. 4 is a side view of a bomb with a mounted guidance package.
Figure 6:
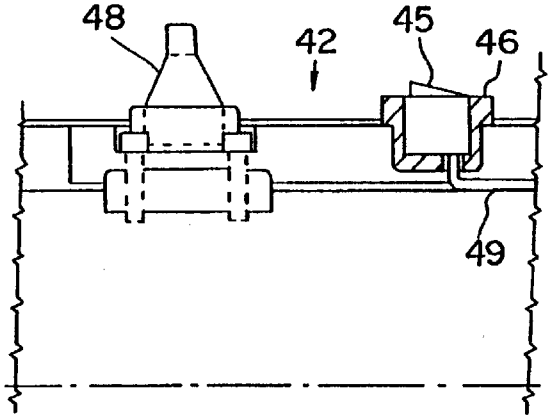
FIG. 6 is a sectional view of a forward clamp of the shroud.

FIG. 4 is a side view of the shrouded bomb 20 with a guidance package attached. The guidance package includes a nose guidance unit 102 having target sensing devices (not illustrated), and a tail fin unit 104. The nose guidance unit 102 has fins 106 that are controllable by the nose guidance unit 102 for steering the bomb during free-fall and a folding fin stabilization assembly. The guidance package, including the fins, does not form a part of this invention, except that the shroud is designed to accept mounting of a guidance package, as explained below.

Figure 5:
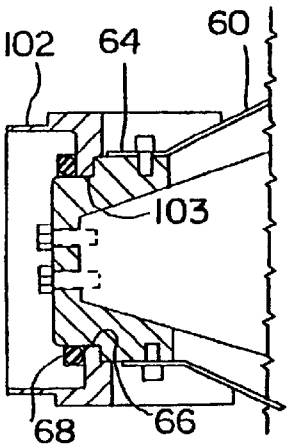
FIG. 5 is a sectional view of a nose portion of the shrouded warhead showing attachment structure for a nose guidance unit.

As shown in FIG. 5, the nose ring 64 sits on the nose end of the penetrating body 24, and is fastened to the front end of the penetrating body and to the nose cone 60 of the shroud. The nose ring 64 includes a circumferential groove 66 that accepts a mating rib 163 of the nose unit 102. A retaining ring 68 secures the nose unit 102 to the nose ring 64.

FIG. 7 illustrates a tail fin mounting arrangement. The tail ring 80 includes a v-shaped groove 84 that mates with a conventional ring clamp (not shown) of a tail fin unit.

A fuze 110 is installed in the tail end of the penetrating body 24. To activate the fuze 110, a power generator 45, a wind-driven turbine, is mounted in a seat 46 in the upper part of the forward clamp 42. The generator 45 is active when the bomb is in free-fall to generate electric power to activate the fuze 110. A cable 49 to connect the generator 45 to the fuze 110 is routed in a space between the shroud 40 and the penetrating body 24, thus passing under the mid shell 70, along the aft clamp 44 and under the aft tube 76 and tail tube 78. The cable 49 is then routed through a hole in the tail ring 80 and into the tail end of the penetrating body 24. A safe/arm device may be included with the fuze 110, and mounted in proximity to the fuze 110 within or on the shroud 40.

The fuze 110 and power generator 45 are not a part of the bomb except that the warhead is designed to accommodate fuzing systems. Other suitable fuzing systems could be used with the bomb.

The invention has been described in terms of preferred embodiments, principles, and examples. Those skilled in the art will recognize that substitutions and equivalents may be made without departing from the scope of the invention as defined in the following claims.

What is claimed is:

1. A shrouded aerial bomb, comprising:

a penetrating body having a nose section shaped with an ogive and having a hollow bore with an opening at a tail end and extending toward the nose section; and an aerodynamic shroud mounted to an outer surface of the penetrating body, the shroud having an outer surface and including at least one clamp mounted to a center potion of the penetrating body, wherein the at least one clamp includes a forward clamp and an aft clamp mounted in longitudinally spaced relationship, each clamp including two semi-cylindrical parts fastened together to encircle the penetrating body, said forward clamp and said aft clamp forming a portion of said outer surface of said shroud, wherein an aerodynamic shape of the shroud is substantially identical to an aerodynamic shape of a selected, qualified aerial bomb and the penetrating body and shroud have a weight, center of gravity, and moments of inertia substantially similar to a weight, center of gravity, and moments of inertia of said selected, qualified aerial bomb.

2. The shrouded aerial bomb as claimed in claim 1, further comprising means for resisting movement of the clamps relative to the penetrating body during pre-impact handling and movement of the bomb.

3. The shrouded aerial bomb as claimed in claim 1, wherein the shroud includes a nose cone shaped with an ogive, a forward tube fastened to the nose cone and the forward clamp, shells attached between the clamps, an aft tube fastened to the aft clamp, and a tail tubular section fastened to the aft tube.

4. The shrouded aerial bomb as claimed in claim 3, wherein the nose section includes a forwardly extending collar to impact a target and transmit an impact force to the nose section for stripping the nose section from the penetrating body.

5. The shrouded aerial bomb as claimed in claim 1, further comprising a plurality of supporting rings mounted between the shroud and the penetrating body to support the shroud during lifting, said rings being disposed at least in the nose section and the tail section.

6. The shrouded aerial bomb as claimed in claim 1, further comprising a wind-driven generator mounted in a seat in one of said at least one clamp for generating electrical power for a fuze, and a power cable extending in a space between the shroud and the penetrating body from said hole to the tail end of the penetrating body to connect the generator and a fuze.

7. A shrouded aerial bomb, comprising:

a penetrating body having a nose section shaped with an ogive; and, an aerodynamic shroud mounted to an outer surface of the penetrating body, the shroud including a forward clamp and an aft clamp mounted to a center portion of the penetrating body in longitudinally spaced relationship, each clamp including two semi-cylindrical parts fastened together to encircle the penetrating body, a nose cone shaped with an ogive, a forward tube fastened to the nose cone and the forward clamp, shells attached between the clamps, an aft tube fastened to the aft clamp, and a tail tubular section fastened to the aft tube, the shroud having an outer shape approximating an outer shape of a selected qualified bomb.

8. The shrouded aerial bomb as claimed in claim 7, further comprising means for resisting movement of the clamps relative to the penetrating body during handling and carriage of the bomb.

9. The shrouded aerial bomb as claimed in claim 7, wherein an outer diameter of the penetrating body is less than an outer diameter of the selected, qualified aerial bomb.

10. The shrouded aerial bomb as claimed in claim 7, wherein a total weight of the penetrating body and the shroud is approximately equal to a weight of the selected, qualified aerial bomb.

11. The shrouded aerial bomb as claimed in claim 7, wherein the shroud is formed of a material having a strength less than a strength of a material forming the penetrating body, so that the shroud is strippable from the penetrating body by impact with a target.

12. The shrouded aerial bomb as claimed in claim 7, further comprising a plurality of supporting rings mounted between the shroud and the penetrating body to support the shroud during lifting, said rings being disposed at least in the nose section and the tail section.

13. The shrouded aerial bomb as claimed in claim 7, further comprising a wind-driven generator mounted in a seat in one of said clamps for generating electrical power for a fuze, and a power cable extending in a space between the shroud and the penetrating body from said hole to the tail end of the penetrating body to connect the generator and a fuze.

14. The shrouded aerial bomb as claimed in claim 7, further comprising means for mounting a guidance nose piece and a guidance tail piece to one of the penetrating body and the shroud.

15. The shrouded aerial bomb as claimed in claim 7, wherein the penetrating body is formed from tungsten.

16. The shrouded aerial bomb as claimed in claim 7, wherein the penetrating body is formed of depleted uranium.

17. A shrouded aerial bomb, comprising:

a penetrating body having a nose section shaped with an ogive and having a hollow bore with an opening at a tail end and extending toward the nose section; and an aerodynamic shroud mounted to an outer surface of the penetrating body, the shroud having an outer surface and including at least one clamp mounted to a center portion of the penetrating body, wherein the at least one clamp includes a forward clamp and an aft clamp mounted in longitudinally spaced relationship, each clamp including semi-cylindrical parts fastened together to encircle the penetrating body, said forward clamp and said aft clamp forming a portion of said outer surface of said shroud.

18. A shrouded aerial bomb, comprising:

a penetrating body having a nose section shaped with an ogive; and an aerodynamic shroud mounted to an outer surface of the penetrating body, the shroud including a forward clamp and an aft clamp mounted to a center portion of the penetrating body in longitudinally spaced relationship, each clamp including two semi-cylindrical parts fastened together to encircle the penetrating body, a nose cone shaped with an ogive, a forward tube fastened to the nose cone and the forward clamp, shells attached between the clamps, and an aft tube fastened to the aft clamp, and a tail tubular section fastened to the aft tube.

* * * * *